US011666162B2

(12) United States Patent
Titus, III

(10) Patent No.: US 11,666,162 B2
(45) Date of Patent: Jun. 6, 2023

(54) SPLIT BEDDING PROVIDING INDEPENDENT MOVEMENT AND COMFORT ON BOTH SIDES OF THE BED

(71) Applicant: Jack L. Titus, III, Andover, MN (US)

(72) Inventor: Jack L. Titus, III, Andover, MN (US)

( * ) Notice: Subject to any disclaimer, the term of this patent is extended or adjusted under 35 U.S.C. 154(b) by 208 days.

(21) Appl. No.: 17/104,631

(22) Filed: Nov. 25, 2020

(65) Prior Publication Data

US 2021/0161316 A1 Jun. 3, 2021

Related U.S. Application Data

(60) Provisional application No. 62/942,007, filed on Nov. 29, 2019.

(51) Int. Cl.
*A47G 9/02* (2006.01)

(52) U.S. Cl.
CPC ..... *A47G 9/0246* (2013.01)

(58) Field of Classification Search
CPC ..... A47G 9/02; A47G 9/0207; A47G 9/023; A47G 9/0238; A47G 9/0246
See application file for complete search history.

(56) References Cited

U.S. PATENT DOCUMENTS 2,730,728 A * 1/1956 Roberts ..... A47G 9/023 5/486
3,066,323 A * 12/1962 Kintner ..... A47G 9/0246 297/DIG. 6
3,072,776 A * 1/1963 Quenneville ..... A47G 9/023 5/486
3,438,068 A * 4/1969 Anderson ..... A47G 9/0246 5/497
4,045,832 A * 9/1977 DiForti ..... A47G 9/0246 5/496
4,144,602 A * 3/1979 Fernandes ..... A47C 21/022 5/923
4,301,561 A * 11/1981 McLeod ..... A47C 21/022 5/923
4,802,251 A * 2/1989 O'Dell ..... A47G 9/02 5/494
5,765,241 A * 6/1998 Macdonald ..... A47G 9/0246 112/475.08
5,943,717 A 8/1999 Alexander
6,311,347 B1 11/2001 Limardi et al.
6,341,396 B1 1/2002 Carapezza
7,100,223 B1 9/2006 Anthony
9,420,904 B1 8/2016 Russell
(Continued)

FOREIGN PATENT DOCUMENTS

FR 3049182 A1 9/2017

*Primary Examiner* — Eric J Kurilla
(74) *Attorney, Agent, or Firm* — Dorsey & Whitney LLP

(57) ABSTRACT

Example split bedding systems include a first sheet section comprising a first side portion and a first end portion and a second sheet section comprising a second side portion and a second end portion. The first end portion having a first tuck flap region extending between opposing notched-out corners, and the second end portion having a second tuck flap region between opposing notched-out corners. The first side portion of the first sheet section overlaps with the second side portion of the second sheet section. Part of the first tuck flap region and part of the second tuck flap region are attached via an attachment system to form a joined sheet.

16 Claims, 6 Drawing Sheets

(56) References Cited

U.S. PATENT DOCUMENTS

| | | | | |
|---|---|---|---|---|
| 10,016,078 | B1 * | 7/2018 | McDermott | A47G 9/0238 |
| 2003/0121100 | A1 | 7/2003 | Fabian | |
| 2005/0273930 | A1 * | 12/2005 | Phillipps | A47G 9/0223 5/486 |
| 2006/0272093 | A1 | 12/2006 | Russ | |
| 2007/0061967 | A1 | 3/2007 | Fox | |
| 2009/0199336 | A1 * | 8/2009 | Gentile | A47G 9/023 5/486 |
| 2011/0023234 | A1 * | 2/2011 | Bolish | A47G 9/02 5/496 |
| 2011/0252563 | A1 | 10/2011 | Horstman | |
| 2012/0186015 | A1 * | 7/2012 | Shattuck | A47G 9/02 5/500 |
| 2013/0014326 | A1 | 1/2013 | Kane et al. | |
| 2014/0026321 | A1 | 1/2014 | Lyons | |
| 2014/0352062 | A1 | 12/2014 | Messina | |
| 2015/0305523 | A1 | 10/2015 | Zimmermann | |
| 2015/0342376 | A1 | 12/2015 | Hallan | |
| 2016/0166091 | A1 | 6/2016 | Carlson et al. | |
| 2018/0263386 | A1 | 9/2018 | Janney | |
| 2018/0279813 | A1 * | 10/2018 | Romez | A47G 9/1045 |
| 2019/0380506 | A1 * | 12/2019 | Calhoun | A47C 31/105 |
| 2022/0233004 | A1 * | 7/2022 | Buchanan | A47G 9/02 |

* cited by examiner

SPLIT BEDDING PROVIDING INDEPENDENT MOVEMENT AND COMFORT ON BOTH SIDES OF THE BED

CROSS-REFERENCE TO RELATED APPLICATIONS

This application claims priority to U.S. Provisional Patent Application No. 62/942,007, filed Nov. 29, 2019, entitled "Split bedding providing independent movement and comfort on both sides of the bed", which is incorporated by reference herein, in the entirety and for all purposes.

BACKGROUND

Conventional bedding options for sleeping with a partner limit freedom of movement and comfort due to movement of the bedding by one person causing affecting the other person. Some solutions for split bedding exist that attempt to offer freedom of movement and comfort, but these solutions tend to bind or twist and tear apart when the individual sheets/blankets are moved in their full range of motion. In addition, existing split bedding solutions are less aesthetically pleasing as compared with traditional bedding solutions.

DETAILED DESCRIPTION

Figure 1:
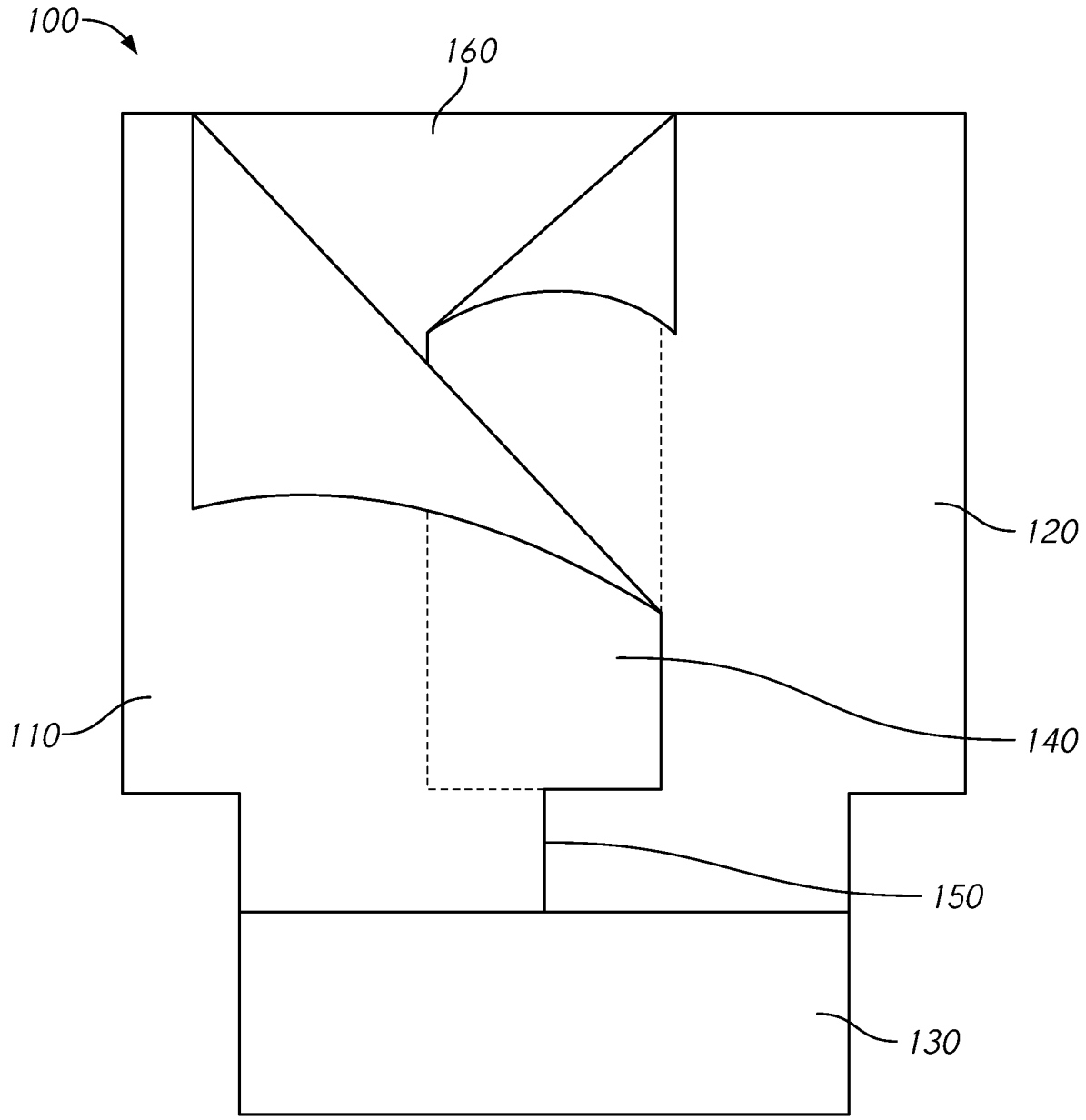
FIG. 1 depicts a top-down plane view of a mattress covering system in accordance with embodiments of the disclosure.

This disclosure describes examples of split sheets/bedding that include two bed sheet sections that are partially joined together near one common end such that a respective side edge of each of the two bed sheet sections overlap with each other. It is appreciated that the use of the term "sheet" in this disclosure may include any type of bedding, such as top or flat sheets, blankets, comforters, duvet covers, etc., or any combination thereof. In addition, while the description of the split sheets/bedding generally references a single layer of bedding or fabric, the split sheet/bedding system may include multiple layers of bedding, including different types of bedding (e.g., sheets plus blankets, blankets plus comforters, sheets plus comforters, etc.).

In some examples, the two bed sheet sections may be joined together near the common end portion that drops over a foot-end of a mattress to be tucked under the mattress to hold the split sheet bedding in place on a bed. In some embodiments, the split bedding may be constructed by joining the two sheet sections together directly at the tuck flap region via an attachment system (e.g., stitching, adhesive, mechanical fasteners, or any combination thereof. In some embodiments, the split sheet bedding may be constructed by joining the tuck flap region of each of the two bed sheet portions to a third bed sheet section (e.g., tuck flap connector section) that extends along the common ends of the two bed sheet sections via an attachment system 150 (e.g., stitching, adhesive, mechanical fasteners, or any combination thereof). The tuck flap connector may have a rectangular shape that, when joined with the two bed sheet sections, extends across an overlap region at the common ends of the two bed sheet sections, and another region that extends beyond the common ends of the two bed sheet sections to be tucked under the mattress. In some examples, the two bed sheet sections may be interchangeable. In other examples, the two bed sheet sections may be specific to a side of the bed. In some examples, the two bed sheet sections may have a rectangular shape. A width and/or a length of each of the two bed sheet sections may be based on a width and/or a length, respectively, of a mattress on which they will be installed (e.g., double-bed size, queen-bed size, king-bed size, California King-bed size, etc.). In some examples, the width and/or the length may also be based on a depth of the mattress.

In some examples, the two sheet sections may be laid side by side (e.g., left and right sections) with a slight overlap of one respective left and one respective right side of the two sheet sections. The connector strip/tuck flap may be positioned so that all three pieces can be joined (e.g., sewn, glued, buttoned, snapped, or some other fastening mechanism) together across the bottoms of both the left and right sections to form a joined sheet. By joining the two sheet sections in this manner, the joined sheet may be moved independently allowing freedom of movement and maximum temperature control for each individual side of the bed. In addition, by joining the two sheet sections in this manner, the two sheet sections may be securely fastened together and may allow for greater ease in making a bed by helping the bedding to stay tucked in the desired position under the mattress.

In some examples, each of the two sheet sections may include "notches" of varying sizes formed (e.g., cut, sewn, etc.) into one or both inner and outer opposing corners at a tuck flap region end. When laid together, the adjacent inner notches of each of the first and second sheet sections may be placed side-by-side and parallel to each other, such that the two edges are aligned with each other without overlapping.

The outer notches may be formed such that the two edges come together at a corner of the mattress as the side and end portions are draped over the side and end, respectively, of the mattress to form a "mitered" corner effect in the sheet. The disclosed device is unique when compared with other known devices and solutions because it provides: full freedom of movement and maximum temperature control for each individual side of the bed; securely connects each sheet/blanket together while also allowing a portion to be tucked under the mattress to anchor it in place and prevent it from being pulled out or twisted while sleeping; and is also designed to have a nice clean "mitered" look when the bed is made.

The following description of certain embodiments is merely exemplary in nature and is in no way intended to limit the scope of the disclosure or its applications or uses. In the following detailed description of embodiments of the present systems and methods, reference is made to the accompanying drawings which form a part hereof, and which are shown by way of illustration specific embodiments in which the described systems and methods may be practiced. These embodiments are described in sufficient detail to enable those skilled in the art to practice presently disclosed systems and methods, and it is to be understood that other embodiments may be utilized and that structural and logical changes may be made without departing from the spirit and scope of the disclosure. Moreover, for the purpose of clarity, detailed descriptions of certain features will not be discussed when they would be apparent to those with skill in the art so as not to obscure the description of embodiments of the disclosure. The following detailed description is therefore not to be taken in a limiting sense, and the scope of the disclosure is defined only by the appended claims.

FIG. 1 depicts a top-down plane view of a split bedding system 100 in accordance with embodiments of the disclosure. In some examples, the split bedding system 100 may be implemented for use with mattress 160. The split bedding system 100 includes a first sheet section 110 and a second sheet section 120 that overlap at an overlap region 140 of the first sheet section 110 and the second sheet section 120. The split bedding system 100 may include a lower portion (e.g., proximate a foot-end of a bed) and an upper portion (e.g., proximate a head-end of a bed). The lower portion of the split bedding system 100 may include a tuck flap region 130. The tuck flap region 130 having a width in a range of 50% to 100% of a width of the mattress 160. The first sheet section 110 and the second sheet section 120 may be joined at the tuck flap region 130 via an attachment system 150 by sewing or stitching. Examples of the attachment system 150 may additionally or alternatively include thermal fusing, glue, and other adhesives; mechanical fasteners, such as plastic rivets or Zippers; detachable connectors, such as hook and loop fastener, buttons, fabric ties, snaps, etc., or any combination thereof.

The overlap region 140 facilitates the use of the sheet sections 110 and 120 as an integral unit, shared by two people without a gap in coverage between them. The first sheet section 110 and the second sheet section 120 may be interchangeable, in some examples. The first sheet section 110 and the second sheet section 120 may each be fabricated using a textile material, such as fabric. The textile material may be any color, texture, pattern, etc.

The tuck flap region 130 extend from an edge of the foot-end of a mattress 160 to be tucked under the mattress to hold the split bedding system 100 in place on a bed. In some embodiments, the split bedding system 100 may be constructed by joining the two sheet sections 110 and 120 together directly at the tuck flap region 130 via the attachment system 150 (e.g., stitching, adhesive, mechanical fasteners, or any combination thereof).

In some embodiments, the split bedding system 100 may be constructed by joining the tuck flap region 130 of each of the two bed sheet sections 110 and 120 to a third bed sheet section (e.g., tuck flap connector) that extends along the common ends of the two bed sheet sections 110 and 120 in the tuck flap region 130. The two sheet sections 110 and 120 may be may be joined to the tuck flap connector using via an attachment system 150. The tuck flap connector may have a rectangular shape that, when joined with the two bed sheet sections 110 and 120 extending across the region 140 that overlaps the common ends of the two bed sheet sections 110 and 120, and another region that extends beyond the common ends of the two bed sheet sections to be tucked under the mattress 160.

In some examples, the two bed sheet sections 110 and 120 may be interchangeable. In other examples, the two bed sheet sections 110 and 120 may be specific to a side of the bed. In some examples, the two bed sheet sections 110 and 120 may have a rectangular shape. A width and/or a length of each of the two bed sheet sections may be based on a width and/or a length, respectively, of the mattress 160 (e.g., double-bed size, queen-bed size, king-bed size, California King-bed size, etc.). In some examples, the width and/or the length may also be based on a depth of the mattress 160.

In some examples, the two sheet sections 110 and 120 may be laid side by side (e.g., left and right sections) with a slight overlap of one respective left and one respective right side of the two sheet sections 110 and 120 in the overlap region 140. The connector strip/tuck flap may be positioned so that all three pieces (e.g., or the two bed sheet sections 110 and 120 when directly joined) can be joined together across the bottoms of both the left and right sections at the tuck flap region 130 via the attachment system 150 to form the split bedding system 100. By joining the two sheet sections 110 and 120 in this manner, the split bedding system 100 may be moved independently allowing freedom of movement and maximum temperature control for each individual side of the bed. In addition, by joining the two sheet sections in this manner, the two sheet sections may be securely fastened together and may allow for greater ease in making a bed by helping the bedding to stay tucked in the desired position under the mattress.

In some examples, each of the first sheet section 110 and the second sheet section 120 may include "notches" of varying sizes formed (e.g., cut, sewn, etc.) into one or both inner and outer opposing corners at a tuck flap region end. When laid together, the adjacent inner notches of each of the first and second sheet sections may be placed side-by-side and parallel to each other, such that the two edges are aligned with each other without overlapping.

The outer notches may be formed such that the two edges come together at a corner of the mattress 160 as the side and end portions are draped over the side and end, respectively, of the mattress 160 to form a "mitered" corner effect in the sheet. In some examples, the dimensions of the outer notch may be based on a depth of the mattress 160. In some examples, the inner and outer notches may have common dimensions. In other examples, the inner and outer notches may have different dimensions.

Figure 2:
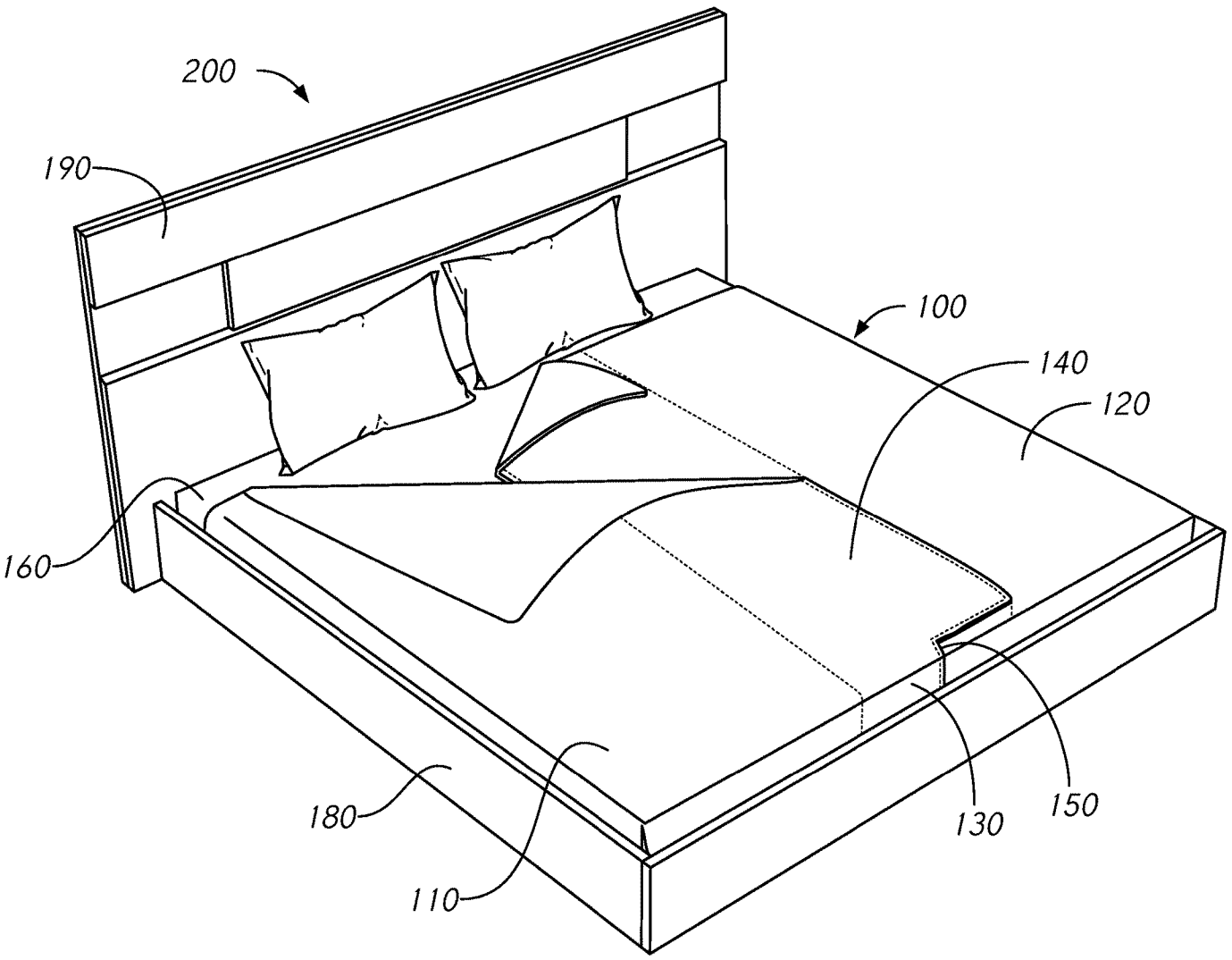
FIGS. 2 and 3 are two perspective views and of an example bed system in accordance with embodiments of the disclosure.
Figure 3:
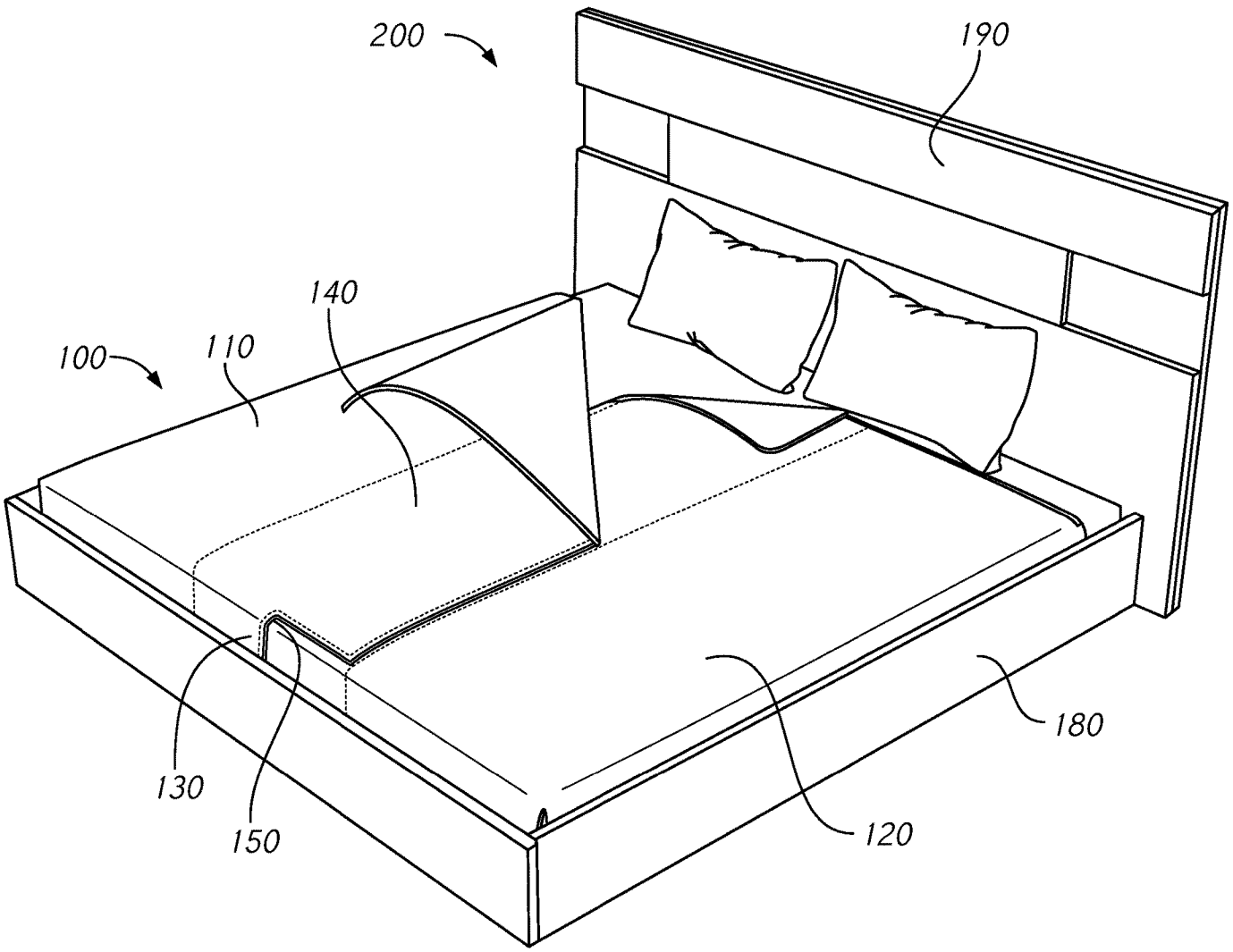

FIGS. 2 and 3 are two perspective views and of an example bed system 200 in accordance with embodiments of the disclosure. The bed system 200 of FIGS. 2 and 3 may include elements that have been previously described with respect to the bedding system 100 of FIG. 1. Those elements have been identified in FIGS. 2 and 3 using the same reference numbers used in FIG. 1 and operation of the common elements is as previously described. Consequently, a detailed description of the operation of these particular elements will not be repeated in the interest of brevity.

The bed system 200 in FIGS. 2 and 3 may further include a bed frame 180 and a headboard. While the bed system 200 depicts a platform-style bed frame, it is appreciated that the split bedding system 100 may be used on other types of bed frames or bed systems (or no bed frame at all) without departing from the scope of the disclosure, including mattress and box spring systems, air mattresses, etc. It is also appreciated that the split bed system 100 may be used on bed systems any type of headboard, or in bed systems with no headboard at all. The bed frame 180 and the headboard 190 may hold the mattress 160. By joining the two sheet sections 110 and 120 in the manner described with reference to FIG. 1, the split bedding system 100 may be moved independently allowing freedom of movement and maximum temperature control for each individual side of the bed system 200. In addition, by joining the two sheet sections in this manner, the two sheet sections may be securely fastened together and may allow for greater ease in making a bed by helping the bedding to stay tucked in the desired position under the mattress.

Figure 4A:
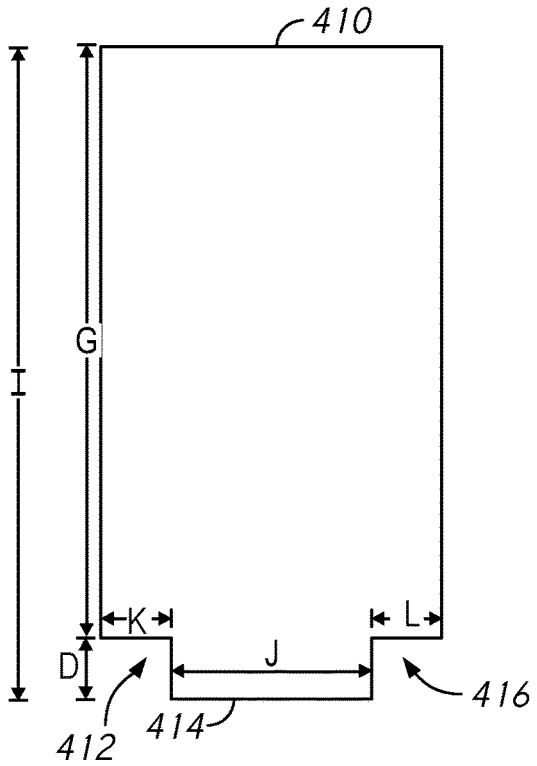
FIGS. 4A-4C depict a top-down, plane view of a split bedding system 400 in accordance with embodiments of the disclosure.
Figure 4B:
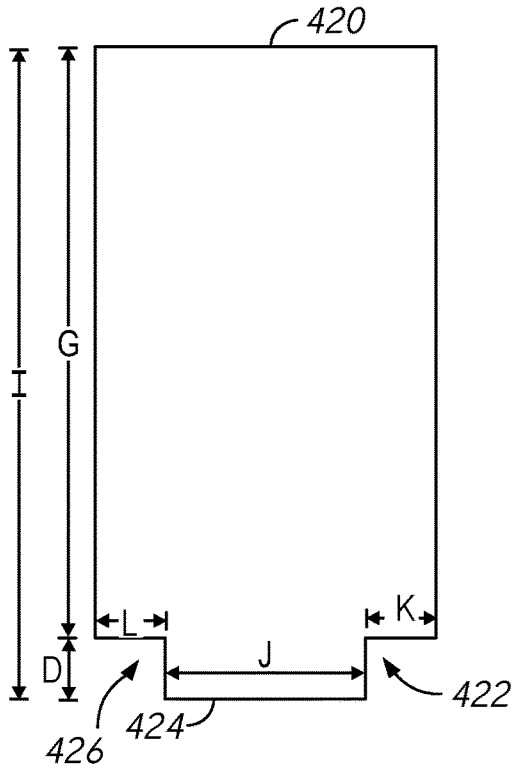
Figure 4C:
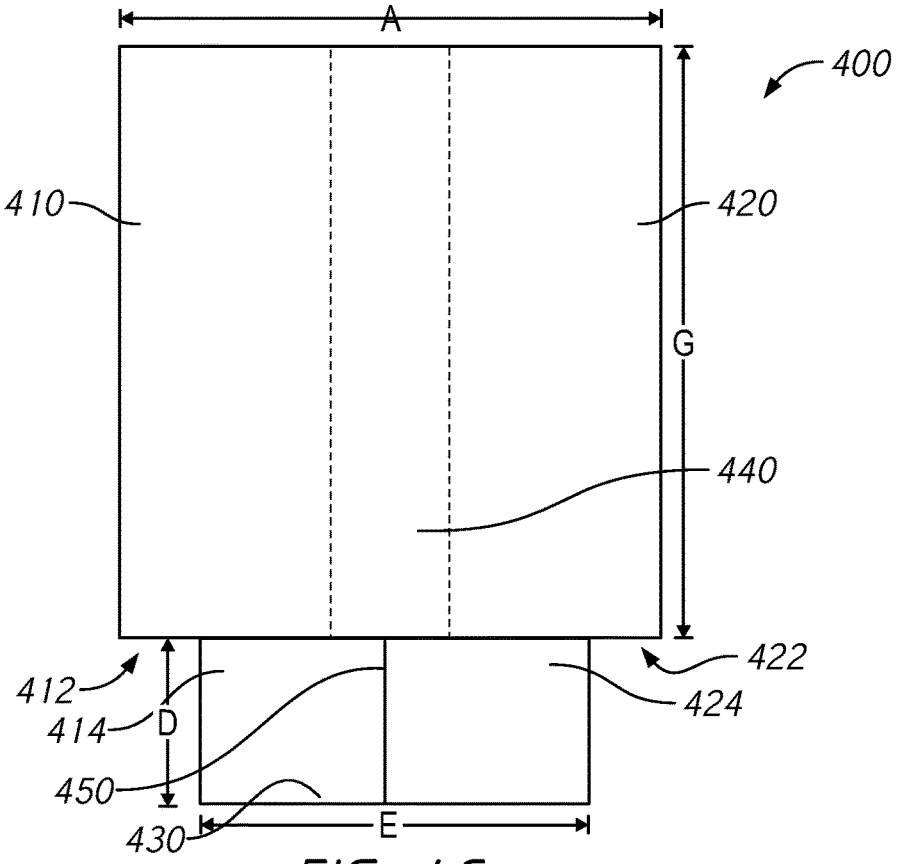

FIGS. 4A-4C depict a top-down, plane view of a split bedding system 400 in accordance with embodiments of the disclosure. FIG. 4A depicts a plane view of a first sheet section 410, FIG. 4B depicts a plane view of a second sheet section 420. FIG. 4C depicts a plane view of a view the split bedding system 400 including the first sheet section 410 of FIG. 4A joined with the second sheet section 420 of FIG. 4B.

The first sheet section 410 may include a tuck flap region 414 with an outer notch 412 and an inner notch 416. The first sheet section 410 may have a width (e.g., measured in a second direction from a first outer edge to a second outer edge) "A" and a total length (e.g., measured in a second direction orthogonal to the first direction from a third outer edge to a fourth outer edge) "I". The outer notch 412 may have a width "K" and a length "D". The inner notch 416 may have a width "L" and a length "D". In some examples, the width "K" and a width "L" may be equal. In other examples, the width "K" and a width "L" may be different. The width "K" and may be based, at least in part, on a depth of a mattress (e.g., the mattress 160 of any of FIGS. 1-3. Taking away the width "K" and "L", the first sheet section 410 may have a tuck flap region 414 with a width "J" and a length "D".

The second sheet section 420 may include a tuck flap region 424 with an outer notch 422 and an inner notch 426. The second sheet section 420 may have a width (e.g., measured in a second direction from a first outer edge to a second outer edge) "A" and a total length (e.g., measured in a second direction orthogonal to the first direction from a third outer edge to a fourth outer edge) "I". The outer notch 422 may have a width "K" and a length "D". The inner notch 426 may have a width "L" and a length "D". In some examples, the width "K" and a width "L" may be equal. In other examples, the width "K" and a width "L" may be different. The width "K" and may be based, at least in part, on a depth of a mattress (e.g., the mattress 160 of any of FIGS. 1-3. Taking away the width "K" and "L", the second sheet section 420 may have a tuck flap region 424 with a width "J" and a length "D". In some examples, the first sheet section 410 and the second sheet section 420 may be mirror images of each other with common dimensions. In other examples, the first sheet section 410 and the second sheet section 420 may have different widths.

As shown in FIG. 4C, the first sheet section 410 and the second sheet section 420 may be joined together via an attachment system 450 at the tuck flap region 414 and the tuck flap region 424 of the first sheet section 410 and the 420, respectively, to form the split bedding system 400 with a tuck flap region 430. The tuck flap region 430 may have a width "E". In some examples, the width "E" may fall in a range of 50% to 100% of a width of the mattress on which the split bedding system 400 is to be installed. The attachment system 450 may include sewing or stitching. Examples of the attachment system 450 may additionally or alternatively include stitching or sewing, thermal fusing, glue, and other adhesives; mechanical fasteners, such as plastic rivets or Zippers; detachable connectors, such as hook and loop fastener, buttons, fabric ties, snaps, etc., or any combination thereof.

The overlap region 440 facilitates the use of the first and second sheet sections 410 and 420 as an integral unit, shared by two people without a gap in coverage between them. The first sheet section 410 and the second sheet section 420 may be interchangeable, in some examples. The first sheet section 410 and the second sheet section 420 may each be fabricated using a textile material, such as fabric. The textile material may be any color, texture, pattern, etc.

The tuck flap region 414 and the tuck flap region 424 may be formed such that the two edges come together at a corner of the mattress as the side and end portions are draped over the side and end, respectively, of the mattress to form a "mitered" corner effect in the sheet.

Figure 5A:
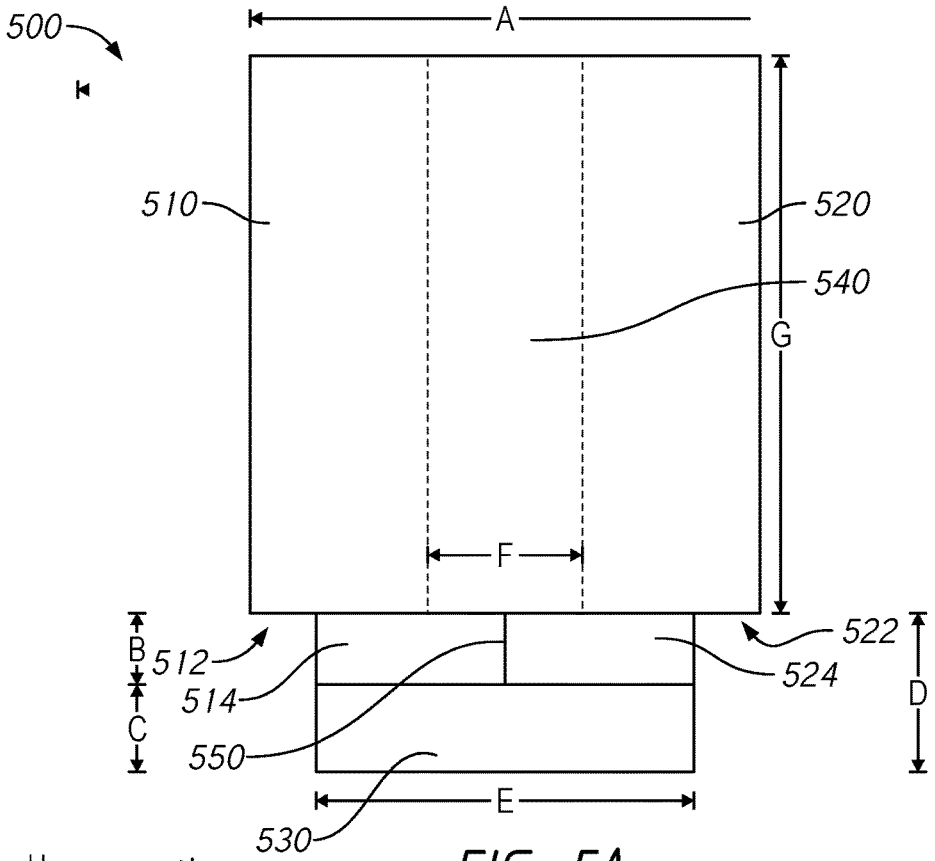
FIGS. 5A-5C depict a top-down, plane view of a split bedding system 500 in accordance with embodiments of the disclosure.
Figure 5B:
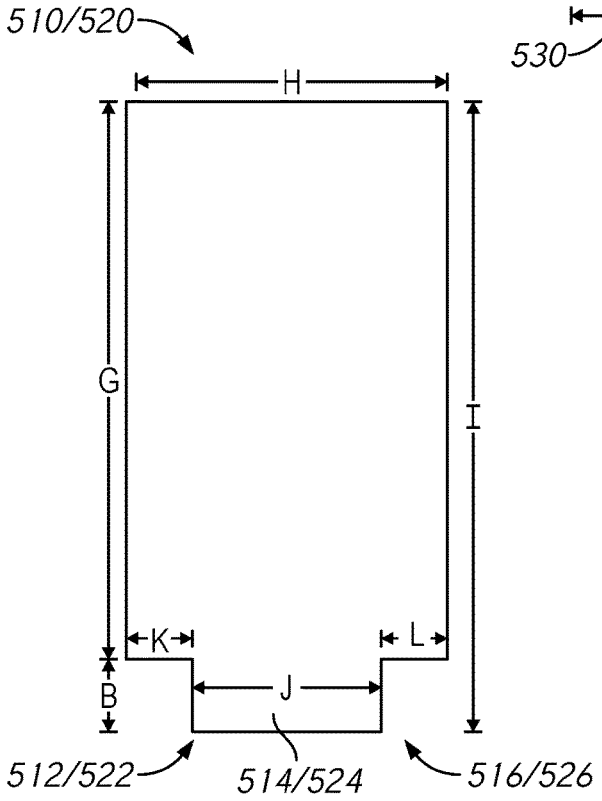
Figure 5C:
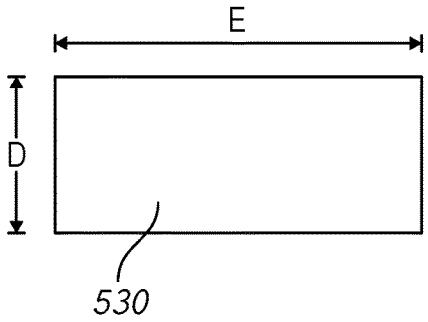

FIGS. 5A-5C depict a top-down, plane view of a split bedding system 500 in accordance with embodiments of the disclosure. FIG. 5A depicts a plane view of the split bedding system 500, FIG. 5B depicts a plane view of a first sheet section 510 and a second sheet section 520. FIG. 5C depicts a plane view of a view a tuck flap connector 530 including the first sheet section 510 of FIG. 5A joined with the second sheet section 520 of FIG. 5B.

Referring to FIG. 5B, the first sheet section 510 may include a tuck flap region 514 with an outer notch 512 and an inner notch 516. The first sheet section 510 may have a width (e.g., measured in a second direction from a first outer edge to a second outer edge) "A" and a total length (e.g., measured in a second direction orthogonal to the first direction from a third outer edge to a fourth outer edge) "I". The outer notch 512 may have a width "K" and a length "B". The inner notch 516 may have a width "L" and a length "B". In some examples, the width "K" and a width "L" may be equal. In other examples, the width "K" and a width "L" may be different. The width "K" and may be based, at least in part, on a depth of a mattress (e.g., the mattress 160 of any of FIGS. 1-3. Taking away the width "K" and "L", the first sheet section 510 may have a tuck flap region 514 with a width "J" and a length "B".

Further in reference to FIG. 5B, the second sheet section 520 may include a tuck flap region 524 with an outer notch 522 and an inner notch 526. The second sheet section 420 may have a width (e.g., measured in a second direction from a first outer edge to a second outer edge) "A" and a total length (e.g., measured in a second direction orthogonal to the first direction from a third outer edge to a fourth outer edge) "I". The outer notch 522 may have a width "K" and a length "B". The inner notch 526 may have a width "L" and a length "B". In some examples, the width "K" and a width "L" may be equal. In other examples, the width "K" and a width "L" may be different. The width "K" and may be based, at least in part, on a depth of a mattress (e.g., the mattress 160 of any of FIGS. 1-3). Taking away the width "K" and "L", the second sheet section 520 may have a tuck flap region 524 with a width "J" and a length "B". In some examples, the first sheet section 510 and the second sheet section 520 may be mirror images of each other with common dimensions. In other examples, the first sheet section 510 and the second sheet section 520 may have different widths.

Referring to FIG. 5C, the tuck flap connector 530 may have a width "E" and a length "D". In some examples, the width "E" may fall in a range of 50% to 100% of a width of the mattress on which the split bedding system 500 is to be installed.

As shown in FIG. 5A, the first sheet section 510, the second sheet section 520, and the tuck flap connector 530 may be joined together at the tuck flap region 514 and the tuck flap region 524 of the first sheet section 510 and the second sheet section 520, respectively, via an attachment system 550 to form the split bedding system 500. The attachment system 550 may include sewing or stitching. Examples of the attachment system 550 may additionally or alternatively include stitching or sewing, thermal fusing, glue, and other adhesives; mechanical fasteners, such as plastic rivets or Zippers; detachable connectors, such as hook and loop fastener, buttons, fabric ties, snaps, etc., or any combination thereof.

The overlap region 540 facilitates the use of the first and second sheet sections first sheet section 510 and second sheet section 520 as an integral unit, shared by two people without a gap in coverage between them. The first sheet section 510 and the second sheet section 520 may be interchangeable, in some examples. The first sheet section 510 and the second sheet section 520 may each be fabricated using a textile material, such as fabric. The textile material may be any color, texture, pattern, etc.

The tuck flap region 514 and the tuck flap region 524 may be formed such that the two edges come together at a corner of the mattress as the side and end portions are draped over the side and end, respectively, of the mattress to form a "mitered" corner effect in the sheet.

Figure 6:
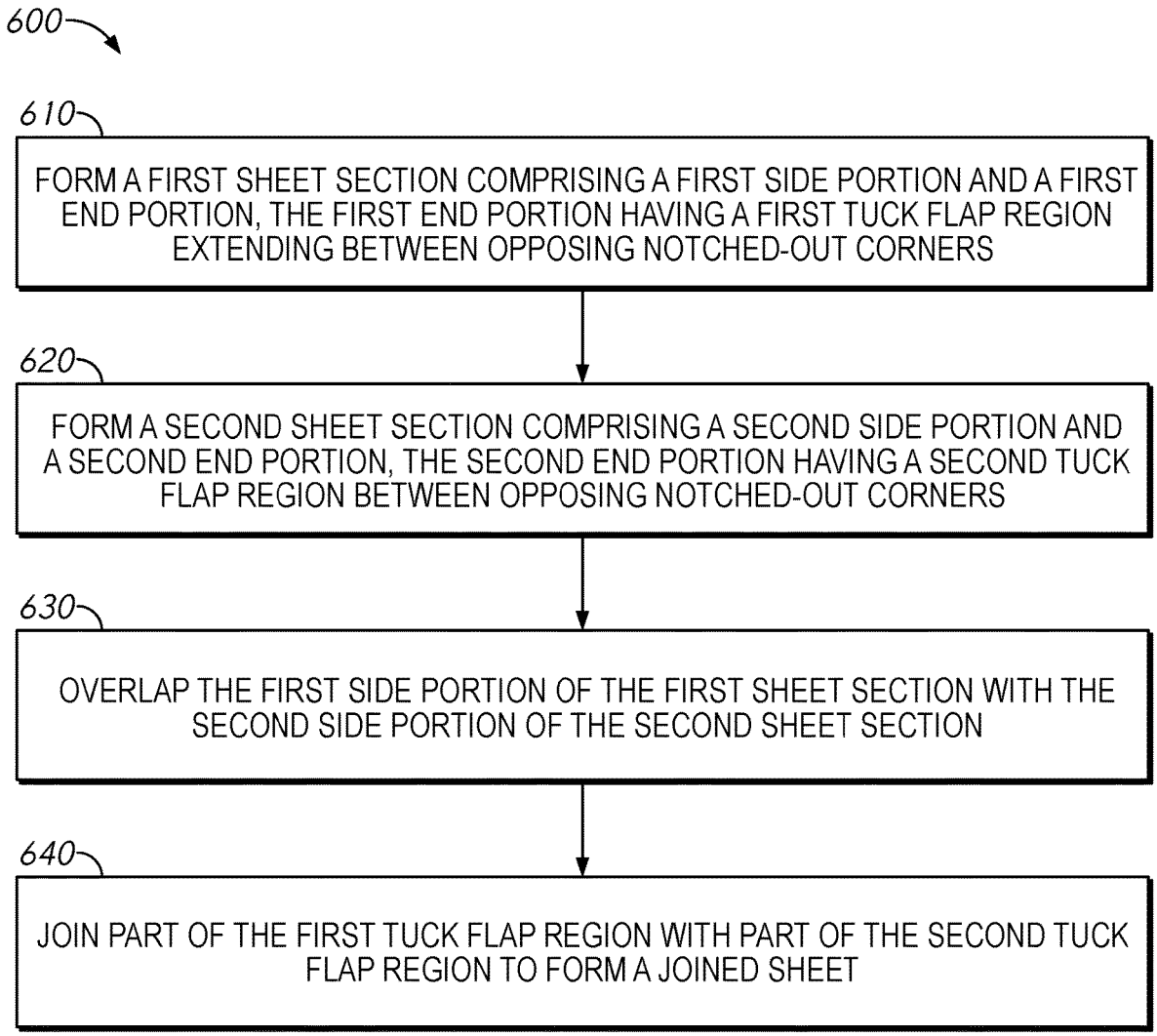
FIG. 6 is a flow diagram of a method 600 in accordance with embodiments of the disclosure.

FIG. 6 is a flow diagram of a method 600 in accordance with embodiments of the disclosure. The method 600 may be implemented to form the split bedding system 100 of any of FIGS. 1-3, the split bedding system 400 of FIG. 4, the split bedding system 500 of FIG. 5, or any combination thereof.

The method 600 may include forming a first sheet section comprising a first side portion and a first end portion, at 610. The first end portion may include a first tuck flap region extending between opposing notched-out corners. The first sheet section may include any of the first sheet section 110 of any of FIGS. 1-3, the first sheet section 410 of FIG. 4, the first sheet section 510 of FIG. 5, or any combination thereof. The first tuck flap region may include the tuck flap region 414 of FIG. 4 or the tuck flap region 514 of FIG. 5. The opposing notched out corners may include the outer notch 412 and the inner notch 416 of FIG. 4 or the outer notch 512 and the inner notch 516 of FIG. 5. In some embodiments, the method 600 may further include forming the opposing notched out corners in each of the first sheet section and the second sheet section. In some examples, the opposing notched out corners have common dimensions. In some examples, the opposing notched out corners have different dimensions.

The method 600 may further include forming a second sheet section comprising second side portion and a second end portion, at 620. The second end portion may include a second tuck flap region between opposing notched-out corners. The second sheet section may include any of the second sheet section 120 of any of FIGS. 1-3, the second sheet section 420 of FIG. 4, the second sheet section 520 of FIG. 5, or any combination thereof. The second tuck flap region may include the tuck flap region 424 of FIG. 4 or the tuck flap region 524 of FIG. 5. The opposing notched out corners may include the outer notch 422 and the inner notch 426 of FIG. 4 or the outer notch 522 and the inner notch 526 of FIG. 5.

The method 600 may further include overlapping the first side portion of the first sheet section with the second side portion of the second sheet section, at 630. The overlap may form an overlap region, such as the overlap region 140 of FIGS. 1-3, the overlap region 440 of FIG. 4, or the overlap region 540 of FIG. 5.

The method 600 may further include joining part of the first tuck flap region with part of the second tuck flap region to form a joined sheet, at attachment system 450. The joined sheet may form a split bedding system, such as the split bedding system 100 of FIGS. 1-3, the split bedding system 400 of FIG. 4, and/or the split bedding system 500 of FIG. 5. In some examples, when installed on a mattress, the first sheet section extends over an edge of one side of the mattress such that one of the opposing notched out corners cause a mitered appearance at a corner of the mattress. The joining of the part of the first tuck flap region with the part of the second tuck flap region may be via an attachment system, such as the attachment system 150 of FIGS. 1-3, the attachment system 450 of FIG. 4, the attachment system 550 of FIG. 5, or any combination thereof. In some embodiments, the method 600 may further include sewing or gluing the part of the first tuck flap region to the part of the second tuck flap region. In some examples, the method 600 may further include joining the part of the first tuck flap region with the part of the second tuck flap region via a mechanical fastener. In some embodiments, the method may further include joining the part of the first tuck flap region with the part of the second tuck flap region via a detachable connector piece.

Although the detailed description describes certain preferred embodiments and examples, it will be understood by those skilled in the art that the scope of the disclosure extends beyond the specifically disclosed embodiments to other alternative embodiments and/or uses of the embodiments and obvious modifications and equivalents thereof. In addition, other modifications which are within the scope of the disclosure will be readily apparent to those of skill in the art. It is also contemplated that various combination or sub-combination of the specific features and aspects of the embodiments may be made and still fall within the scope of the disclosure. It should be understood that various features and aspects of the disclosed embodiments can be combined with or substituted for one another in order to form varying mode of the disclosed embodiments. Thus, it is intended that the scope of at least some of the present disclosure should not be limited by the particular disclosed embodiments described above.

What is claimed is:

1. A method comprising:

forming a first sheet section comprising a first side portion, a first top portion, and a first end portion, the first end portion having a first tuck flap region extending between opposing, symmetrical notched-out corners such that the first top portion is wider than the first tuck flap region;

forming a second sheet section comprising a second side portion, a second top portion, and a second end portion, the second end portion having a second tuck flap region between opposing, symmetrical notched-out corners such that the second top portion is wider than the second tuck flap region;

overlapping the first side portion of the first sheet section with the second side portion of the second sheet section; and joining part of the first tuck flap region with part of the second tuck flap region to form a joined sheet.

2. The method of claim 1, further comprising sewing or gluing the part of the first tuck flap region to the part of the second tuck flap region.

3. The method of claim 1, further comprising joining the part of the first tuck flap region with the part of the second tuck flap region via a mechanical fastener.

4. The method of claim 1, further comprising joining the part of the first tuck flap region with the part of the second tuck flap region via a detachable connector piece.

5. The method of claim 1, further comprising forming the opposing symmetrical notched out corners in each of the first sheet section and the second sheet section.

6. The method of claim 5, further comprising forming the opposing notched out corners in each of the first sheet section and the second sheet section having different dimensions.

7. The method of claim 1, wherein, when installed on a mattress, the first sheet section extends over an edge of one side of the mattress such that one of the opposing notched out corners cause a mitered appearance at a corner of the mattress.

8. A mattress covering comprising:

a first sheet section comprising a first side portion, a first top portion, and a first end portion, the first end portion having a first tuck flap region extending between opposing, symmetrical notched-out corners such that the first top portion is wider than the first tuck flap region; and a second sheet section comprising a second side portion, a second top portion, and a second end portion, the second end portion having a second tuck flap region between opposing symmetrical notched-out corners such that the second top portion is wider than the second tuck flap region;

wherein the first side portion of the first sheet section overlaps with the second side portion of the second sheet section; and wherein part of the first tuck flap region and part of the second tuck flap region are attached via an attachment system to form a joined sheet.

9. The mattress covering of claim 8, wherein a width of the first sheet section and a width of the second sheet section are based on a particular mattress size.

10. The mattress covering of claim 9, wherein the particular mattress size includes a double-bed mattress size, a queen-bed mattress size, or a king-bed mattress size.

11. The mattress covering of claim 8, wherein the attachment system includes stitches or glue.

12. The mattress covering of claim 8, wherein the attachment system includes a mechanical fasteners or a detachable connector.

13. A mattress covering comprising:

a first sheet section comprising a first side portion, a first top portion, and a first end portion, the first end portion having a first tuck flap region extending between opposing, symmetrical notched-out corners such that the first top portion is wider than the first tuck flap region;

a second sheet section comprising a second side portion, a second top portion, and a second end portion, the second end portion having a second tuck flap region between opposing symmetrical notched-out corners such that the second top portion is wider than the second tuck flap region; and a connector portion;

wherein the first side portion of the first sheet section overlaps with the second side portion of the second sheet section; and wherein the connector portion joins the first tuck flap region and the second tuck flap region.

14. The mattress covering of claim 13, wherein the first sheet section, the second sheet section and the connector portion are constructed from a same type of material.

15. The mattress covering of claim 13, wherein the first sheet section, the second sheet section and the connector portion are constructed from a different type of material.

16. The mattress covering of claim 13, wherein the width of the tuck flap is based on a width of a mattress on which it is intended to be installed.

* * * * *